US007658687B2

(12) United States Patent
Hirano

(10) Patent No.: US 7,658,687 B2
(45) Date of Patent: Feb. 9, 2010

(54) WOOD-TYPE GOLF CLUB HEAD

(75) Inventor: Tomoya Hirano, Kobe (JP)

(73) Assignee: SRI Sports Limited, Kobe (JP)

( * ) Notice: Subject to any disclaimer, the term of this patent is extended or adjusted under 35 U.S.C. 154(b) by 73 days.

(21) Appl. No.: 11/882,297

(22) Filed: Jul. 31, 2007

(65) Prior Publication Data

US 2008/0081709 A1 Apr. 3, 2008

(30) Foreign Application Priority Data

Sep. 28, 2006 (JP) ..... 2006-265416

(51) Int. Cl.
*A63B 53/04* (2006.01)

(52) U.S. Cl. ..... 473/345; 473/346; 473/349

(58) Field of Classification Search ..... 473/324–350
See application file for complete search history.

(56) References Cited

U.S. PATENT DOCUMENTS

| | | | | |
|---|---|---|---|---|
| 5,141,230 | A * | 8/1992 | Antonious | 473/327 |
| 5,755,624 | A * | 5/1998 | Helmstetter | 473/291 |
| 5,851,160 | A * | 12/1998 | Rugge et al. | 473/349 |
| 5,935,020 | A * | 8/1999 | Stites et al. | 473/345 |
| 6,315,678 | B1 * | 11/2001 | Teramoto | 473/291 |
| 6,494,790 | B1 * | 12/2002 | Toyota et al. | 473/345 |
| 6,524,194 | B2 * | 2/2003 | McCabe | 473/305 |
| 6,679,786 | B2 * | 1/2004 | McCabe | 473/305 |
| 6,945,877 | B2 * | 9/2005 | Kobayashi et al. | 473/345 |
| 7,241,230 | B2 * | 7/2007 | Tsunoda | 473/324 |
| 7,377,861 | B2 * | 5/2008 | Tateno et al. | 473/345 |
| 7,435,190 | B2 * | 10/2008 | Sugimoto | 473/345 |
| 7,435,191 | B2 * | 10/2008 | Tateno et al. | 473/346 |
| 2006/0287131 | A1 * | 12/2006 | Hirano | 473/345 |
| 2007/0049407 | A1 * | 3/2007 | Tateno et al. | 473/345 |
| 2007/0129167 | A1 * | 6/2007 | Matsunaga | 473/345 |
| 2008/0081709 | A1 * | 4/2008 | Hirano | 473/346 |

FOREIGN PATENT DOCUMENTS

| | | | |
|---|---|---|---|
| JP | 06031421 | A * | 2/1994 |
| JP | 06121845 | A * | 5/1994 |
| JP | 07284546 | A * | 10/1995 |
| JP | 09099121 | A * | 4/1997 |
| JP | 09248353 | A * | 9/1997 |
| JP | 11-155982 | A | 6/1999 |
| JP | 11155982 | A * | 6/1999 |

(Continued)

*Primary Examiner*—Alvin A Hunter
(74) *Attorney, Agent, or Firm*—Birch, Stewart, Kolasch & Birch, LLP

(57) ABSTRACT

A hollow wood-type golf club head with improved directional stability having, in head periphery region Ao including head contour line OL defined by crown portion 4 when viewed from above as a plane view of the head in the standard state, thick wall portion 9 extending along the contour line and expanding toward the hollow portion side to have an increased thickness, wherein the thick wall portion 9 comprises crown thick wall portion 9*c* which forms a part of crown portion 4 and has a thickness of 1.2 to 2.0 mm, and side thick wall portion 9*s* which is continuous with the crown thick wall portion 9*c* and forms a part of side portion 6 and has a thickness of 1.2 to 3.0 mm, and wherein the thick wall portion 9 has a width along the head outer surface of 6 to 16 mm in a vertical section passing through the head center of gravity G in the standard state.

29 Claims, 7 Drawing Sheets

FOREIGN PATENT DOCUMENTS

| | | | | |
|---|---|---|---|---|
| JP | 2000126339 | A | * | 5/2000 |
| JP | 2002035178 | A | * | 2/2002 |
| JP | 2003126307 | A | * | 5/2003 |
| JP | 2003190338 | A | * | 7/2003 |
| JP | 2004008409 | A | * | 1/2004 |
| JP | 2005168665 | A | * | 6/2005 |
| JP | 2006102247 | A | * | 4/2006 |
| JP | 2007054201 | A | * | 3/2007 |

* cited by examiner

WOOD-TYPE GOLF CLUB HEAD

BACKGROUND OF THE INVENTION

The present invention relates to a golf club head, and more particularly to a wood-type golf club head having a good flight direction performance of hit ball improved by realizing a large moment of inertia.

In recent years, large-sized golf club heads are popularly used. Since the size increase must be done within a limited weight range, the degree of freedom in weight distribution design is lowered. Therefore, in order to increase the moment of inertia of club heads, it is required to efficiently allot a limited weight margin to necessary portions of the heads.

Stabilization of ball flight direction has been conventionally achieved by increasing the moment of inertia of golf club heads. As one of the methods, it is known from, for example, JP-11-155982A to attach a weight member made of an alloy containing a metal material having a high specific gravity such as nickel or tungsten to an appropriate portion of a head body made of titanium, stainless steel or the like.

However, this method requires to specially provide the head body with a fitting portion for fixing the weight member to the head body. The need of such a fitting portion further decreases the weight margin to make efficient weight distribution design difficult.

It is an object of the present invention to provide a wood-type golf club head having an improved directional stability wherein the moment of inertia is increased by efficiently distributing the weight of the club head.

This and other objects of the present invention will become apparent from the description hereinafter.

SUMMARY OF THE INVENTION

It has been found that the weight can be efficiently distributed to increase the moment of inertia with keeping a required thickness of a hollow club head by providing a thick wall portion having specified thickness and width at a part of a corner portion between a crown and a side wall of the club head so as to extend along the corner portion.

In accordance with the present invention, there is provided a wood-type golf club head comprising a face portion having a hitting face for hitting a golf ball on its front side, a crown portion extending from the upper edge of the hitting face and forming an upper surface of the club head, a sole portion extending from the lower edge of the hitting face and forming a bottom surface of the club head, a side portion extending between the crown portion and the sole portion from a toe side edge of the hitting face to the heel side edge of the hitting face through a back face, and having a hollow portion inside the head, wherein when viewed from above as a plane view of the head in the standard state that the head is placed on a horizontal plane at prescribed lie and loft angles, a thick wall portion extending along a head contour line defined by the crown portion and expanding toward the hollow portion side to have an increased thickness is provided in a head periphery region including the head contour line, the thick wall portion comprising a crown thick wall portion which forms a part of the crown and has a thickness of 1.2 to 2.0 mm, and a side thick wall portion which is continuous with the crown thick wall portion to form a part of the side portion and has a thickness of 1.2 to 3.0 mm, and the thick wall portion having a width along the head outer surface of 6 to 16 mm in a vertical section passing through the center of gravity of the head in the standard state.

In an embodiment according to the present invention, each of the crown portion and the side portion has a thin wall portion which is adjacent to the thick wall portion and has a thickness of 0.4 to 1.0 mm. Preferably, the ratio of the thickness tac of the crown thick wall portion to the thickness tuc of the thin wall portion of the crown portion (tac/tuc ratio) is from 2.0 to 3.0, and the ratio of the thickness tas of the side thick wall portion to the thickness tus of the thin wall portion of the side portion (tas/tus ratio) is from 2.0 to 4.5.

Preferably, the length L of the thick wall portion measured along the contour line of the head in the standard state when viewed from above is from 50 to 90 mm. Preferably, the thick wall portion having such a length L is disposed in a corner region formed between the crown portion and the side portion at a location such that the distance in the toe-heel direction between the middle point of the length L of the thick wall portion and the center of gravity of the head is from 5 to 40 mm.

Preferably, the thick wall portion is formed so that the side thick wall portion is thicker than the crown thick wall portion.

In the present invention, the golf club head is produced, for example, by welding at least two members and, preferably, the thick wall portion is provided with a hole for inspecting the welded portion from the hollow portion side.

The thick wall portion disposed in the periphery region of the head can distribute much weight to the head periphery region without providing a special structure for supporting it. Moreover, since the width of the thick wall portion is small, the weight can be efficiently and concentrically distributed to the head periphery region. Further, since the thick wall portion comprises a crown thick wall portion constituting a part of the crown portion and a side thick wall portion constituting a part of the side portion, the rigidity of the head periphery region in the crown and side portions is increased to enhance the durability of the head. Thus, according to the present invention, a weight margin can be efficiently utilized for increase of the moment of inertia to improve the flight direction stability.

DETAILED DESCRIPTION

An embodiment of the present invention will be explained below with reference to FIGS. 1 to 4.

Figure 1:
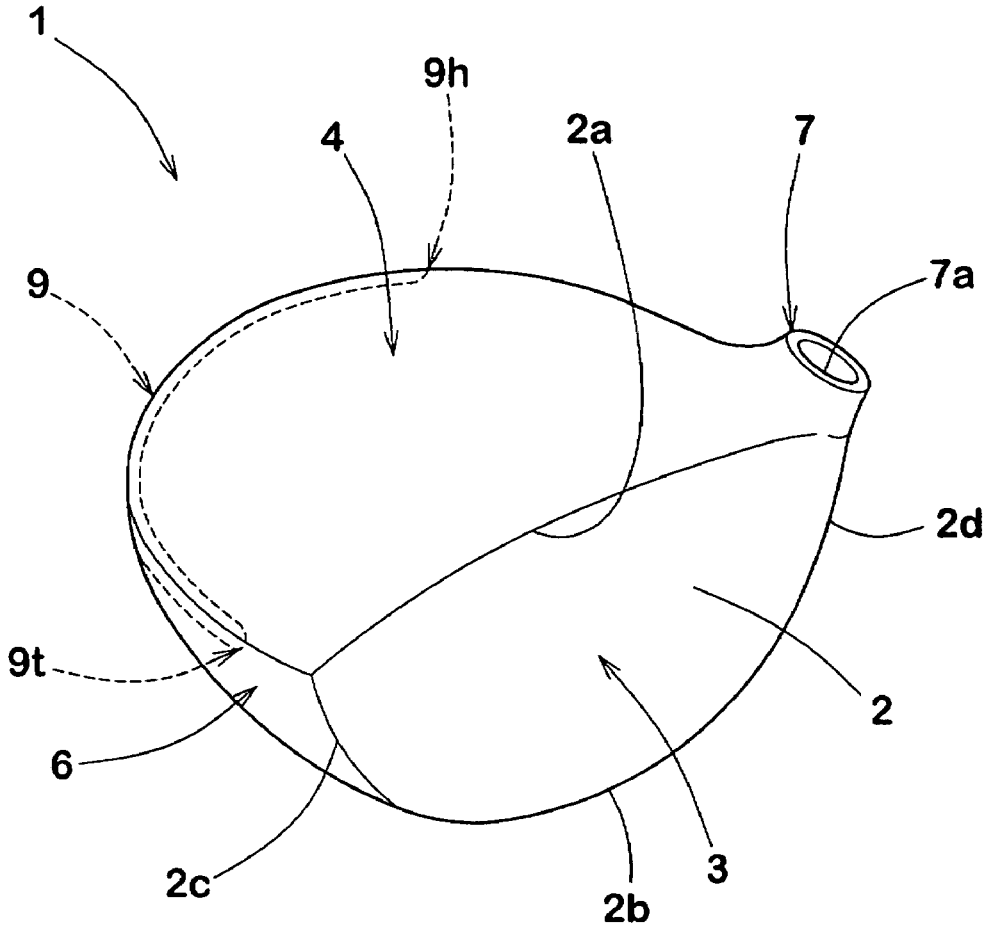
FIG. 1 is a perspective view of a golf club head showing an embodiment of the present invention.
Figure 2:
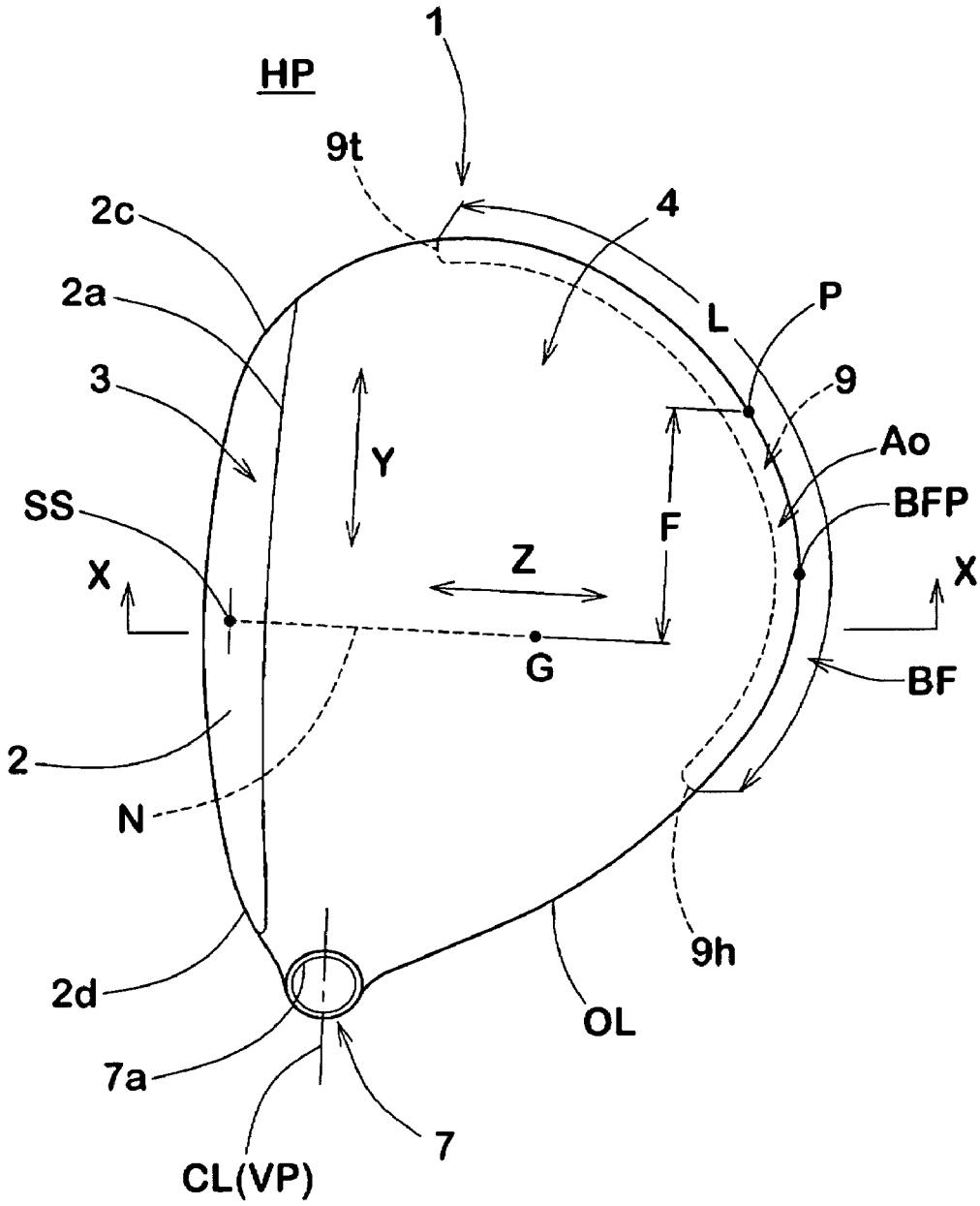
FIG. 2 is a plan view of the club head shown in FIG. 1 in the standard state.
Figure 3:
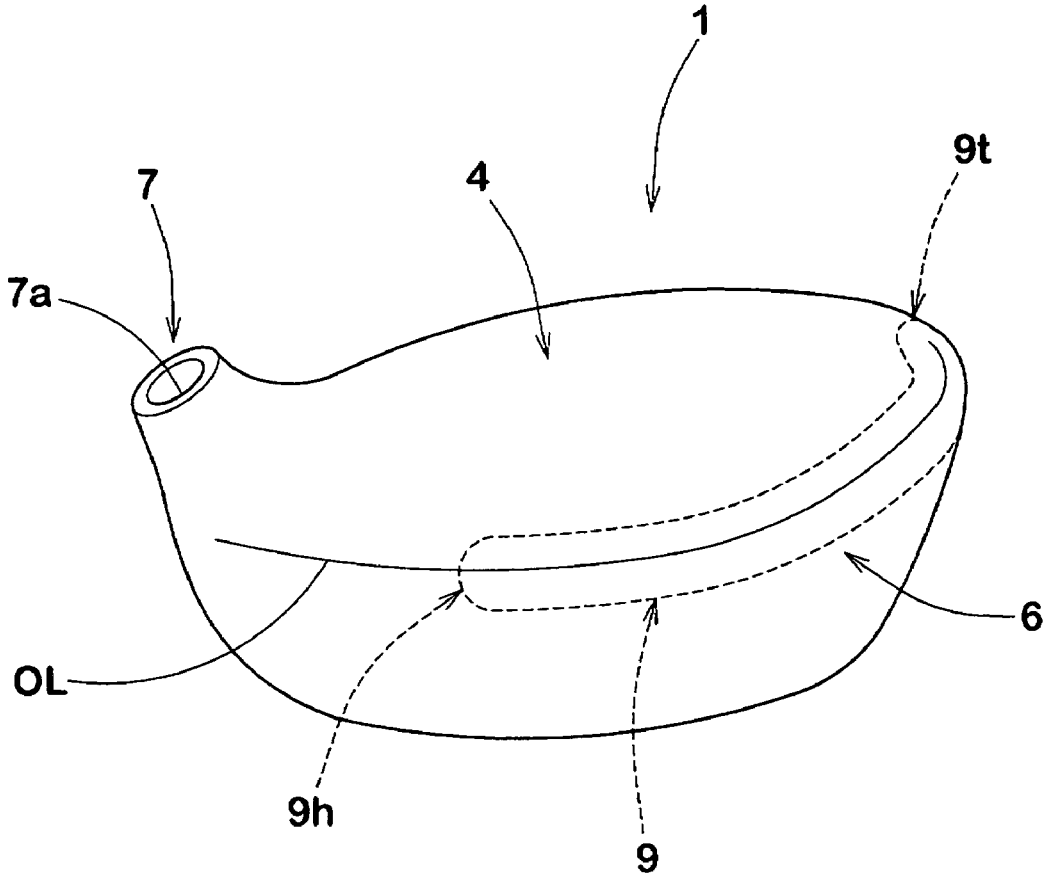
FIG. 3 is a rear elevational view of the club head.

FIGS. 1 to 4 are perspective, plan and rear elevational views of a wood-type golf club head 1 in the standard state according to an embodiment of the present invention, and an enlarged cross sectional view along the line X-X shown in FIG. 2, respectively.

The term "standard state" of a golf club head as used herein denotes the state that golf club head 1 is placed on a horizontal plane HP in the state that an axial center line CL of a shaft is disposed in an optional vertical plane VP and is inclined at a lie angle given to the head 1 with respect to the horizontal plane HP, and a hitting face 2 is inclined at a loft angle (real loft angle, herein after the same) given to the head 1. The head 1 referred to herein is in the standard state unless otherwise noted.

Figure 4:
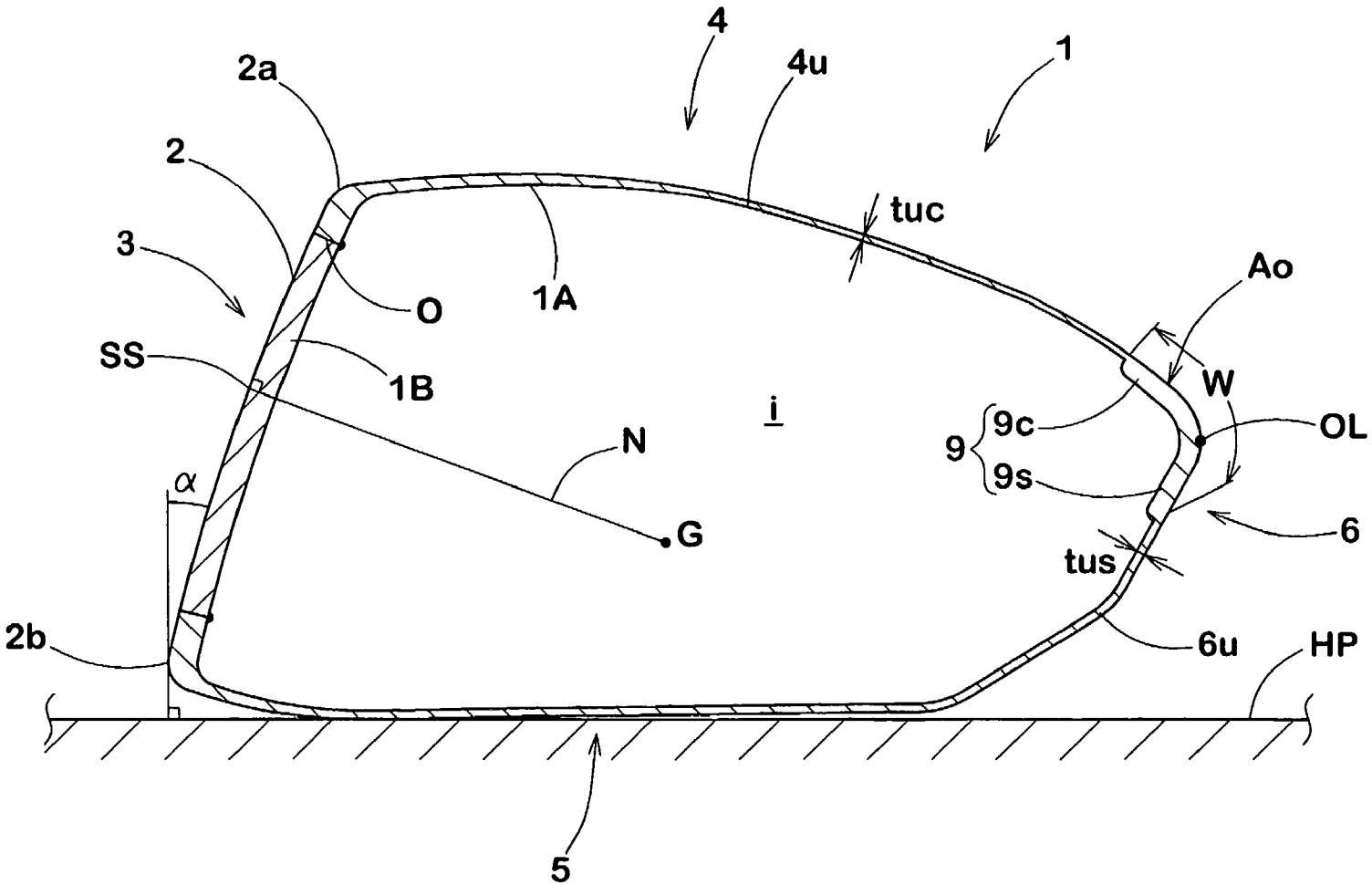
FIG. 4 is an enlarged cross sectional view along the line X-X shown in FIG. 2.

Further, with respect to the club head 1, the up-and-down direction and the height direction denote those of the club head 1 in the standard state. The front-and-rear direction denotes, when the club head 1 in the standard state is viewed from above, namely in a plane view of the head 1 (FIG. 2), a direction Z which is parallel to a normal line N drawn from the center of gravity G to the face 2, and a face 2 side is the front and a back face BF side is the rear or back. The toe-and-heel direction of the head 1 denotes a direction Y which is perpendicular to the front-and-rear direction Z in the plane view (FIG. 2). In FIGS. 2 and 4, the mark "SS" denotes a sweet spot which is a point where a normal line N drawn to the face 2 from the center of gravity G of the head 1 intersects the face 2.

The golf club head 1 includes a face portion 3 having a face 2 for hitting a golf ball on its front side, a crown portion 4 which extends from the upper edge 2*a* of the hitting face 2 and forming the upper surface of the head 1, a sole portion 5 which extends from the lower edge 2*b* of the hitting face 2 and forming the bottom surface of the head 1, a side portion 6 which extends between the crown portion 4 and the sole portion 5 from a toe side edge 2*c* of the face 2 to a heel side edge 2*d* of the face 2 through a back face BF of the head 1, and a hosel portion 7 which is disposed on a heel side of the crown portion 5 and has a shaft inserting hole 7*a* to attach a shaft (not shown). Since the axial center line of the shaft inserting hole 7*a* substantially agrees with the center line CL of the shaft, it is used as a basis to determine the lie angle.

As shown in FIG. 4, the golf club head 1 is formed into a hollow structure having a hollow interior "i". The term "wood-type golf club head" does not mean that the head is made of a woody material, but means golf club heads having a so-called wood-type head shape, e.g., driver (#1 wood), brassy (#2 wood), spoon (#3 wood), baffy (#4 wood) and cleek (#5 wood) and comprehends heads which are different from these heads in number or name, but have a shape approximately similar to these heads.

The club head 1 in this embodiment is produced from a metallic material. Preferable examples of the metallic material are, for instance, a stainless steel, a marageing steel, a pure titanium, a titanium alloy, an aluminum allow, and combinations of these metals. Fiber-reinforced plastics may be used in a part of the head 1.

The club head 1 in this embodiment has, as shown in FIG. 4, a two piece structure comprising a head body 1A having an opening O on the face side, and a plate-like face member 1B fixed to the opening O of the head body 1A by welding. The head body 1A can be produced in a known manner. In this embodiment, a face portion 3 having the opening O, a crown portion 4, a sole portion 5, a side portion 6 and a hosel portion 7 are integrally formed into a head body 1A by a lost-wax precision casting method. The face member 1B can be produced in a known manner, for example, by forging, rolling or casting. The golf club head of the invention is not limited to such a head 1 having a two piece structure, and various changes and modifications can of course be made.

The volume of the club head 1 is not particularly limited. In view of the object of the present invention of increasing the moment of inertia, the volume of the head is preferably at least 360 $cm^3$, more preferably at least 380 $cm^3$. On the other hand, if the volume is too large, the resulting golf club head will not meet golf rules or the durability is deteriorated since the increase in volume of the head must be made within a limited weight range. From such a point of view, the volume of head 1 is preferably at most 470 $cm^3$, more preferably at most 460 $cm^3$.

In consideration of swing balance or the like, the weight of head 1 is preferably at least 170 g, more preferably at least 180 g, and is preferably at most 250 g, more preferably at most 240 g. In particular, in case of a driver head, the head 1 is preferred to have a weight of 200 g or less.

When viewed from above as a plane view of the head in the standard state as shown in FIG. 2, the club head 1 is provided with a thick wall portion 9 extending along a head contour line OL defined by the crown portion 4 in a head periphery region Ao including the head contour line OL. The head contour line OL corresponds to a location to which the crown portion 4 projects or extends the most toward the outside of the head to form the contour line. Therefore, in case of a club head 1 having a loft angle of 0° or more, the edge on the face side of the crown portion 4 does not participate in this head contour line OL. Also, the contour line OL is defined, in a vertical section of the head including its center of gravity G, as a location at which the head projects the most toward the outside. That is to say, the head contour line OL is a contour line of the crown portion 4 placed in the standard state when viewed from above as a plane view, provided that in case of a club head 1 having a loft angle of 0° or more, the edge on the face side of the crown portion 4 does not participate in the head contour line OL.

Figure 5:
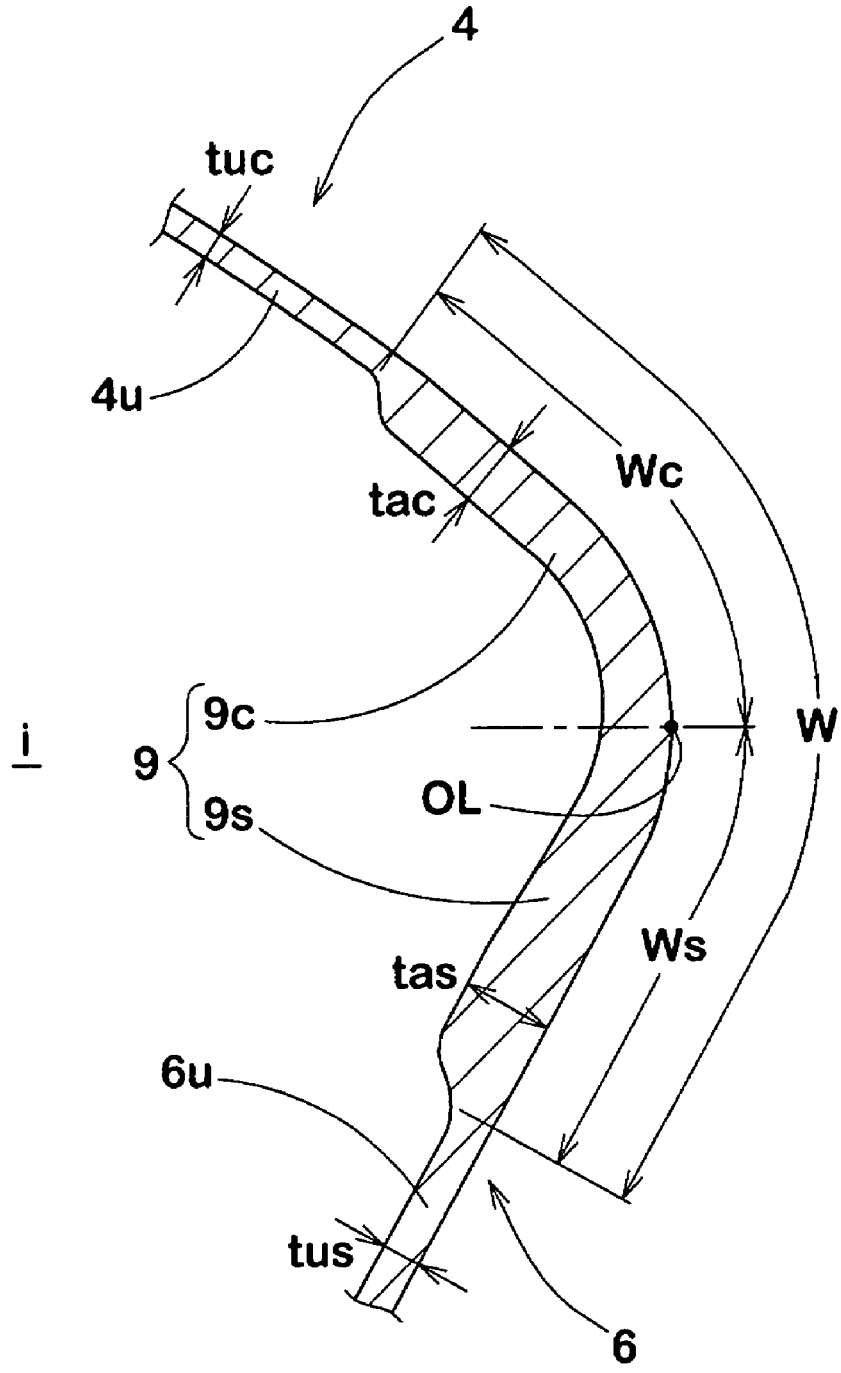
FIG. 5 is a partial enlarged view showing a thick wall portion in FIG. 4.

As shown in FIGS. 4 and 5, the thick wall portion 9 expands or projects toward the hollow portion "i" side to have a larger thickness than the wall thickness of the crown portion 4 and the side portion 6. Since the outer surface of the thick wall portion 9 forms a smooth surface with the crown portion 4 and the side portion 6, it is not distinguishable.

The thick wall portion 9 comprises a crown thick wall portion 9*c* which forms a part of the crown portion 4 and has a thickness "tac" of 1.2 to 2.0 mm, and a side thick wall portion 9*s* which is continuous with the crown thick wall portion 9*c* to form a part of the side portion 6 and has a thickness "tas" of 1.2 to 3.0 mm. In other words, the thick wall portion 9 includes the head contour line OL and is located above and below the head contour line OL.

Such a thick wall portion 9 can distribute a larger weight to the head periphery region Ao by a simple structure. Also, it does not require a special structure like a supporting means or the like as required when separately preparing a weight member and attaching it to a club head. Thus, the weight can be efficiently distributed to the head periphery region Ao and, therefore, the moment of inertia of the club head 1 can be increased to stabilize the flight direction performance.

The thick wall portion 9 in this embodiment is produced by casting. That is to say, the thick wall portion 9 is simultaneously formed when forming the head body 1A by casting. Therefore, the thick wall portion 9 can be formed with good size precision such as thickness and width without lowering the productivity. This is advantageous as compared with attachment of a separately prepared weight member, since deterioration in productivity can be more surely prevented.

The entire of the side portion 6 may be formed thick as a thick wall portion 9. However, in such an embodiment, a rigidity difference is easy to generate in the vicinity of a boundary portion (i.e., head contour line OL) between the side portion 6 and the crown portion 4. Therefore, in such a case, a stress generated when striking a ball is easy to concentrate on the boundary portion, whereby the durability of head 1 is impaired. In contrast, in case of an embodiment as shown in FIGS. 1 to 4, the thick wall portion 9 of the golf club head 1 comprises a crown thick wall portion 9*c* which forms a part of the crown portion 4, and a side thick wall portion 9*s* which forms a part of the side portion 6. Therefore, the rigidity of the head periphery region Ao of the crown and side portions 4 and 6 can be increased with good balance, whereby stress concentration on the head contour line OL can be prevented to increase the durability.

If the thickness tac of the crown thick wall portion 9*c* is less than 1.2 mm, the weight is not sufficiently allocated to the head periphery region Ao and, therefore, the effect of increasing the moment of inertia of the head is not obtained. On the other hand, if the thickness tac of the crown thick wall portion 9*c* is more than 2.0 mm, the weight of a head upper portion is apt to increase to raise the position of the center of gravity G. Such a club head tends to increase the back spin amount and, therefore, loss of flight distance may occur. From such points of view, the thickness tac of the crown thick wall portion 9*c* is preferably 1.5 mm or more, and is preferably 1.8 mm or less.

Similarly, if the thickness tas of the side thick wall portion 9*s* is less than 1.2 mm, the weight is not sufficiently distributed to the head periphery region Ao and, therefore, the effect of increasing the moment of inertia of the head is not obtained. On the other hand, if the thickness tas of the side thick wall portion 9*s* is more than 3.0 mm, pin holes are easy to generate when the head is produced by casting. From such points of view, the thickness tas of the side thick wall portion 9*s* is preferably 1.5 mm or more, more preferably 1.7 mm or more, the most preferably 2.0 mm or more, and is preferably 2.8 mm or less, more preferably 2.5 mm or less.

The side thick wall portion 9*s* also serves to lower the center of gravity location. Therefore, it is more preferable to make the thickness tas of the side thick wall portion 9*s* larger than the thickness tac of the crown thick wall portion 9*c* so as to achieve a low center of gravity with increasing the moment of inertia. In that case, it is also preferable to form the entire thick wall portion 9 so that the thickness gradually and smoothly increases from the crown thick wall portion 9*c* toward the side thick wall portion 9*s*.

In order to exhibit both the effect of lowering the center of gravity location and the effect of increasing the moment of inertia in good balance, it is preferable that the difference (tas-tac) between the thickness tas of the side thick wall portion 9*s* and the thickness tac of the crown thick wall portion 9*c* is at least 0.5 mm, especially at least 0.7 mm, and is at most 2.0 mm, especially at most 1.5 mm.

Further, in a vertical section passing through the center of gravity G of the head (FIG. 4 being one of such vertical sections), the thick wall portion 9 is required to have a width W along the head outer surface of 6 to 16 mm. The width W may be constant throughout the full length L of the thick wall portion 9 or may be suitably varied along the length direction within the above range. If the width W of the thick wall portion 9 is less than 6 mm, pinholes are easy to generate at the time of casting, so molding failure may occur. If the width W of the thick wall portion 9 is more than 16 mm, the weight of the thick wall portion 9 is dispersed to a wide range and, therefore, the effect of increasing the moment of inertia is not sufficiently obtained. From such points of view, the width W of the thick wall portion 9 is preferably at least 8 mm, more preferably at least 10 mm, and is preferably at most 14 mm, more preferably at most 12 mm.

For exhibiting both the effect of increasing the moment of inertia and the effect of reinforcing a neighborhood of the head contour line OL in good balance, it is preferable that the width Wc along the head outer surface of the crown thick wall portion 9*c* is at least 2 mm, especially at least 4 mm, and is at most 10 mm, especially at most 8 mm, more especially at most 6 mm. Similarly, it is preferable that the width Ws along the head outer surface of the side thick wall portion 9*s* is at least 3 mm, especially at least 5 mm, and is at most 14 mm, especially at most 10 mm, more especially at most 8 mm.

In particular, it is preferable in maintaining a low center of gravity of the head 1 that the width Ws of the side thick wall portion 9*s* is larger than the width Wc of the crown thick wall portion 9*c*. It is particularly preferable that a difference "Ws−Wc" between the width Ws of the side thick wall portion 9*s* and the width Wc of the crown thick wall portion 9 is 1 mm or more, especially 2 mm or more. On the other hand, if the difference "Ws−Wc" is too large, there is a possibility that the durability of the thick wall portion 9 is lowered. Therefore, preferably the difference "Ws−Wc" is 6 mm or less, especially 4 mm or less.

A thin wall portion 4*u* having a thickness "tuc" of 0.4 to 1.0 mm is disposed in the crown portion 4 with being contiguous to the crown thick wall portion 9*c*. In this embodiment as shown in FIGS. 1 to 4, substantially the whole area of the crown portion 4 excepting the crown thick wall portion 9*c* is formed by the thin wall portion 4*u*. Since a large impact acts on a neighborhood of a boundary between the crown portion 4 and the face portion 3 when striking a golf ball, it is preferable to gradually increase the thickness "tuc" of the thin wall portion 4*u* of the crown portion 4 toward the face portion 3.

Similarly, a thin wall portion 6*u* having a thickness "tus" of 0.4 to 1.0 mm is disposed in the side portion 6 with being contiguous to the side thick wall portion 9*s*. In this embodiment as shown in FIGS. 1 to 4, substantially the whole area of the side portion 6 excepting the side thick wall portion 9*s* is formed by the thin wall portion 6*u*. Since a large impact acts on a neighborhood of a boundary between the side portion 6 and the face portion 3 when striking a golf ball, it is preferable to gradually increase the thickness "tus" of the thin wall portion 6*u* of the side portion 6 toward the face portion 3.

Since the weight of the crown and side portions is decreased by thinning the wall thickness thereof, these thin wall portions 4*u* and 6*u* may provide a new weight margin enabling to form the thick wall portion 9 having a larger thickness so as to further increase the moment of inertia.

If the thickness "tuc" or "tus" of the thin wall portion 4*u* or 6*u* is less than 0.4 mm, the crown portion 4 or side portion 6 is short of strength and the durability of the club head is remarkably deteriorated. Further, since the molten metal is hard to flow in these portions when conducting the casting, molding failure may occur. Therefore, the thickness "tuc" and "tus" is preferably at least 0.5 mm, more preferably at least 0.6 mm. On the other hand, if the thickness "tuc" or "tus" is more than 1.0 mm, no effective weight margin utilizable for increasing the moment of inertia is obtained from the crown portion 4 or side portion 6. In particular, in case that the thickness of the thin wall portion 4*u* of the crown portion 4 exceeds 1.0 mm, the weight of a head upper portion becomes large, so the location of the head center of gravity tends to be high. Therefore, the thickness "tuc" and "tus" is preferably at most 0.9 mm, more preferably at most 0.8 mm.

From the viewpoint of lowering the location of the head center of gravity G, it is preferable that the thickness "tus" of the thin wall portion 6*u* of the side portion 6 is larger than the thickness "tuc" of the thin wall portion 4*u* of the crown portion 4. In particular, from the viewpoint of effective weight distribution to realize a low center of gravity and a good strength balance, a thickness difference "tus-tuc" is preferably at least 0.05 mm, more preferably at least 0.1 mm, the most preferably at least 0.2 mm, and is preferably at most 1.0 mm, more preferably at most 0.5 mm.

Further, in the crown portion 4, it is preferable that the ratio of the thickness tac of the crown thick wall portion 9*c* to the thickness tuc of the thin wall portion 4*u* of the crown portion 4 (tac/tuc ratio) is at least 2.0, especially at least 2.2, more especially at least 2.4. If the tac/tus ratio is less than 2.0, there is a possibility that a proper weight distribution, namely the effect of increasing the moment of inertia, is not sufficiently achieved. On the other hand, if the tac/tus ratio is too large, there is a possibility that the casting formability is lowered or a stress concentrates on a boundary portion between the thick and thin wall portions to deteriorate the durability. From such points of view, it is preferable that the tac/tus ratio is at most 3.0, especially at most 2.8, more especially at most 2.6.

Similarly, in the side portion 6, it is preferable that the ratio of the thickness tas of the side thick wall portion 9*s* to the thickness tus of the thin wall portion 6*u* of the side portion 6 (tas/tus ratio) is at least 2.0, especially at least 2.5, more especially at least 3.0, and is at most 4.5, especially at most 3.5.

It is desirable that the thick wall portion 9 is continuous with the thin wall portion 4*u* or 6*u* with gradually decreasing its thickness, whereby stress concentration on the boundary portion between the thick wall portion 9 and the thin wall portion 4*u* or 6*u* is suppressed to prevent deterioration of the durability of the head.

The thick wall portion 9 has a toe side end 9*t* and a heel side end 9*h* and extends between them along the head contour line OL. In this embodiment, the thick wall portion 9 extends to include an extreme back end point BFP which is located at the farthest backward position of the head. Such a thick wall portion 9 can allocate the weight to a more backward position to effectively increase the depth of the center of gravity of the head.

In order to realize a sufficient weight distribution to the head periphery region Ao, it is preferable that the length L of the thick wall portion 9 measured from the toe side end 9*t* to the heel side end 9*h* along the contour line OL of the head in the standard state when viewed from above as a plane view as shown in FIG. 2 is 50 mm or more, especially 60 mm or more. If the length L of the thick wall portion 9 is too small, sufficient weight distribution to the head periphery region Ao is not achieved. In addition, pinholes or sink marks are easy to generate, thus resulting in molding failure. On the other hand, if the length L of the thick wall portion 9 is too large, the weight is dispersed into a wide region, so there is a possibility that the effect of increasing the moment of inertia and the effect of increasing the depth of the center of gravity are lowered. From such a point of view, it is preferable that the length L of the thick wall portion 9 is 90 mm or less, especially 80 mm or less.

When the head 1 in the standard state is viewed from above as a plane view as shown in FIG. 2, it is preferable that the thick wall portion 9 having a length L of 50 to 90 mm is disposed at a location such that a distance F in the toe-heel direction between a middle point P (which is a point on the head contour line OL) of the length L of the thick wall portion 9 and the center of gravity G of the head is from 5 to 40 mm. The larger the distance F, the location of the thick wall portion 9 shifts toward the toe side so as to increase the depth of the center of gravity and the moment of inertia. From such a point of view, the distance F is more preferably at least 10 mm, the most preferably at least 15 mm. On the other hand, if the weight of the thick wall portion 9 is excessively concentrated on the toe side of the head 1, the distance of the head center of gravity (i.e., shortest distance between the center of gravity G and an axial center line CL of a shaft) becomes large since the center of gravity G of the head 1 shifts toward the toe side. Such a club head tends to have a deteriorated directional stability since the face 2 is hard to return back during swing to the address position. Therefore, the distance F is more preferably at most 35 mm, the most preferably at most 30 mm.

Figure 6:
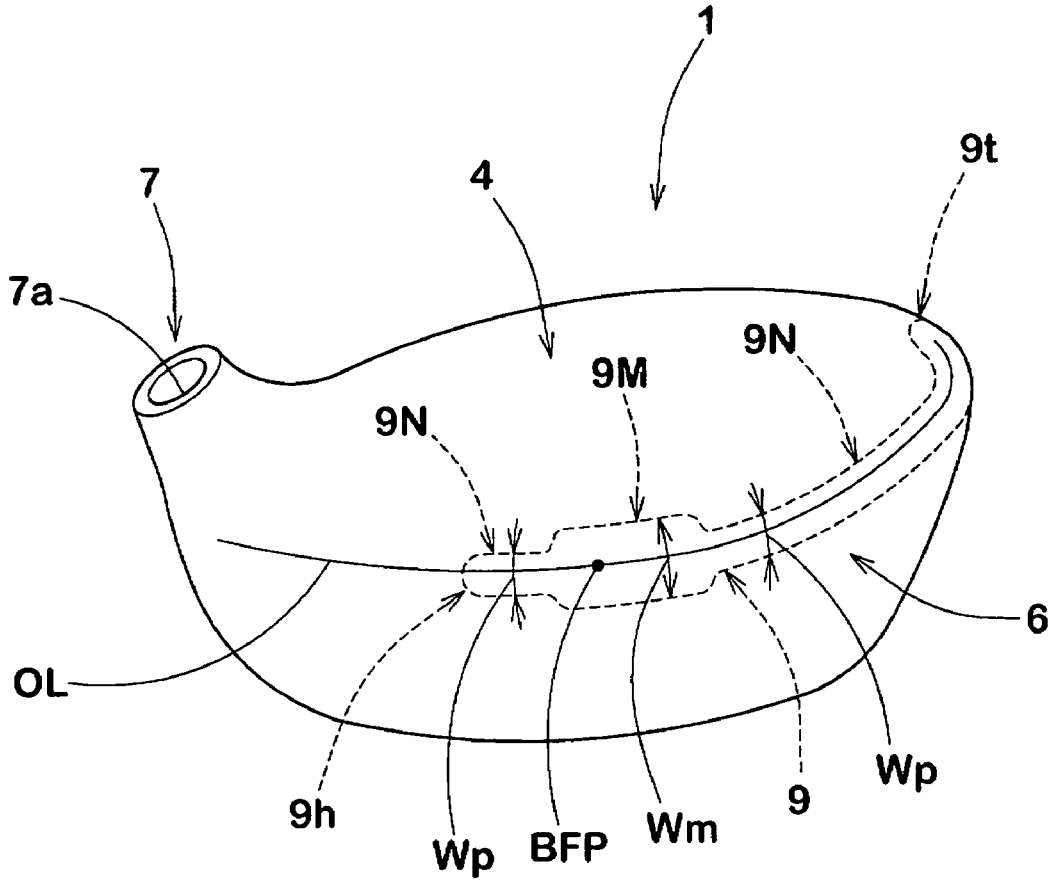
FIG. 6 is a rear elevational view of a golf club head according to another embodiment of the present invention.

FIG. 6 shows another embodiment of the present invention. In this embodiment, the thick wall portion 9 has a varied width, wherein a wide portion 9M having the maximum width Wm is provided in the thick wall portion 9 at a location including the extreme back end point BFP of the back face BF. The maximum width Wm is set within the range of 6 to 16 mm. The thick wall portion 9 includes narrow portions 9N having a smaller width Wp than the wide portion 9M, which are disposed on the both side of the wide portion 9M. The wide portion 9M in this embodiment serves to effectively increase the depth of the center of gravity. The width of the narrow portions 9N is also selected from the range of 6 to 16 mm, but from the viewpoint of optimizing a weight distribution for increasing the depth of the center of gravity, it is preferable that the ratio Wm/Wp of the width Wm of the wide portion 9M to the width Wp of the narrow portions 9N is 1.4 or more.

Figure 7:
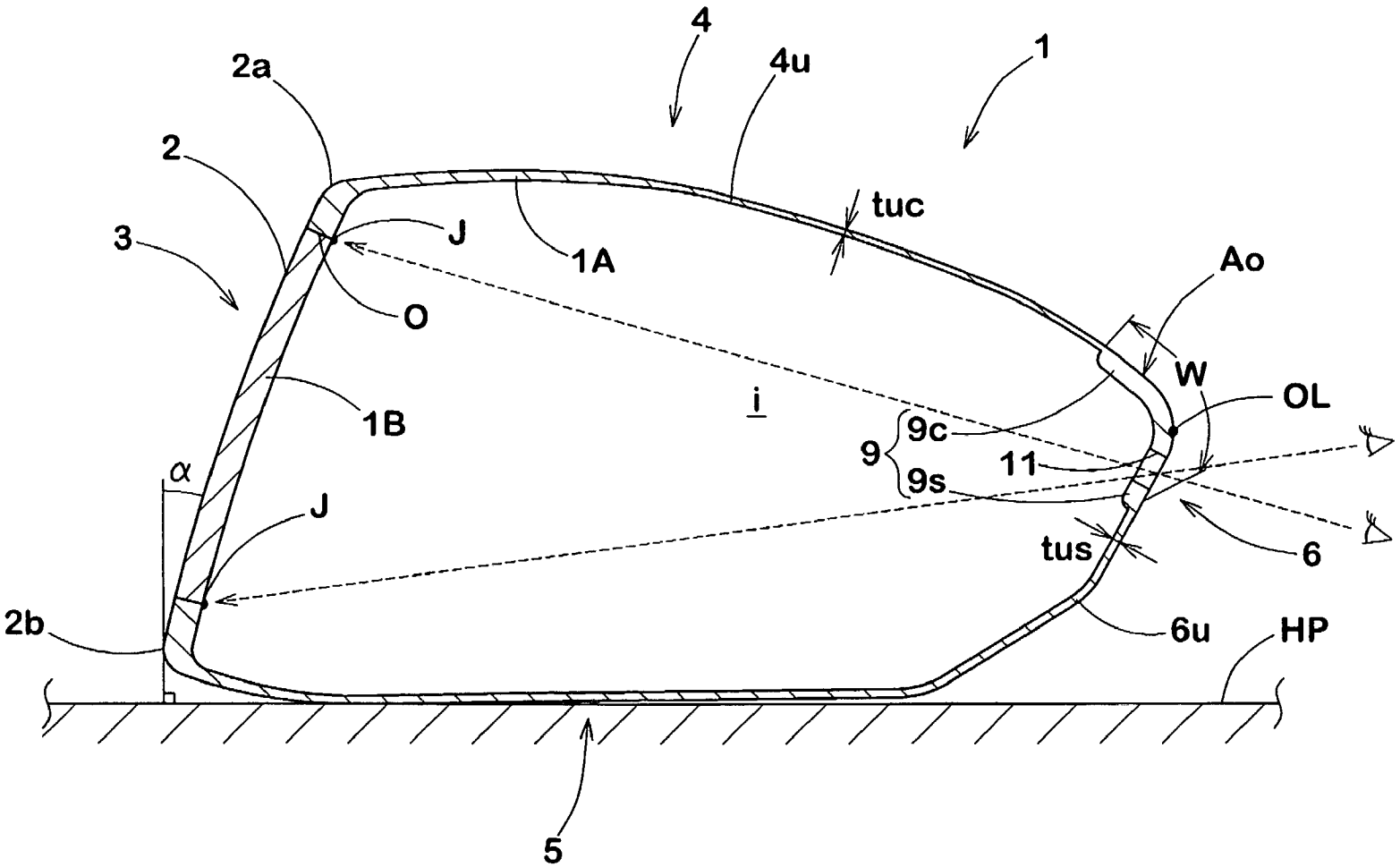
FIG. 7 is a cross sectional view of a golf club head according to a still another embodiment of the present invention.

FIG. 7 shows a still another embodiment of the present invention. The club head 1 in this embodiment has the same base structure as that of the embodiment as shown in FIGS. 1 to 5, but is different from it in that the thick wall portion 9 is provided with an inspection hole 11 capable of visually checking from the hollow portion "i" side a welded portion J at which the face member 1B is welded to the head body 1A. It is known from, for example, JP-A-2004-209091, that in order to visually observe the state of finish of the welded portion from a hollow portion side of a hollow club head, an inspection hole is formed in the head and is filled up later with a welding material or a covering material. However, such an inspection hole remains as a defect for durability even after filling up it. In contrast, in the embodiment of the present invention, at least one inspection hole 11 is formed in the thick wall portion 9, whereby the deterioration in durability of the head due to formation of inspection hole can be prevented since the rigidity is enhanced in the thick wall portion. Two or more inspection holes may be formed, one being for visual inspection and the other being for inserting a light source into a hollow portion "i" of the head 1. After the completion of the inspection, the holes are filled up with a suitable material.

While preferable embodiments of the present invention have been described with reference to the drawings, it goes without saying that the present invention is not limited to only such embodiments and various changes and modifications may be made.

The present invention is more specifically described and explained by means of the following Examples and Comparative Examples. It is to be understood that the present invention is not limited to these Examples.

EXAMPLES 1 TO 4 AND COMPARATIVE EXAMPLES 1 TO 4

Two piece wood-type golf club heads having a base structure as shown in FIGS. 1 to 5 were prepared according to the specifications shown in Table 1 and tested with respect to the performances described below. The specifications common to the respective heads are as follows:

Loft angle: 11.0°

Lie angle: 58.0°

Head volume: 460 $cm^3$

Head weight: 195 g

Material of head body: Ti-6Al-4V (lost-wax casting product)

Material of face member: Ti-6Al-4V (rolling product)

The testing methods are as follows:

[Coefficient of Restitution]

The coefficient of restitution was measured according to the USGA Procedure for Measuring the Velocity Ratio of a Club Head for Conformance to Rule 4-1e, Revision 2, Feb. 8, 1999. The measurement was repeated 10 times for each head, and the average value thereof is shown in Table 1. The larger the value, the better, but the value must be less than 0.83° in order to satisfy the golf rules such as the USGA Golf Rules.

[Flight Distance and Direction Performance of Hitting]

The same FRP shafts were attached to all heads to be tested to give wood gold clubs having a full length of 46 inches. Ten right-hitting amateur golfers (handicap 10 to 20) struck 10 balls with each club, and there were measured the flight distance and the amount (yard) of swerve to the right or left of the stopping position of a struck ball with respect to the target direction of striking (the amount of swerve is shown by a positive value for the both cases of swerving to the right and the left). Each of the results of measurement of the flight distance and the amount of swerve shown in Table 1 is the average of found values obtained by striking 100 balls for each club. The larger the value, the better the flight distance performance. The smaller the value, the better the direction performance.

(1) Depth of the Center of Gravity

The length of the perpendicular line N connecting the center of gravity G and the sweet spot SS was measured. The larger the value, the better.

(2) Moment of Inertia

The moment of inertia about a vertical axis passing through the center of gravity of the golf club head was measured using Moment of Inertia Measuring Instrument Model No. 005-002 made by INERTIA DYNAMICS INC. The larger the value, the better.

(3) Direction Performance for Ball Struck

A same shaft made of an FRP was attached to each of the golf club heads to give a 45 inch wood-type golf club. Each of five golfers having a handicap of 5 to 15 hit ten golf balls with each golf club to measure the amount of swerve from the intended target course to the stop position of the ball.

3a. Amount of Rightward or Leftward Swerve

The amount of rightward or leftward swerve was calculated according to the following equation:

$$\text{Amount of rightward or leftward swerve (yard)} = \sqrt{\{(A1^2 + A2^2 + \ldots + An^2)/n\}}$$

wherein A1, A2 . . . An (n=10) each is an amount (yard) of swerve of the stop position of the ball hit from the target flight course. The smaller the value, the better the direction performance.

3b. Amount of Frontward or Rearward Swerve

The amount of frontward or rearward swerve was calculated according to the following equation:

$$\text{Amount of frontward or rearward swerve (yard)} = \sqrt{[\{(B1 - Ba)^2 + (B2 - Ba)^2 + \ldots + (Bn - Ba)^2\}/n]}$$

wherein B1, B2 . . . Bn (n=10) each is a flight distance for each hitting, and Ba is an average flight distance. The smaller the value, the better the direction performance.

Test results are shown in Table 1.

TABLE 1

| | Ex. 1 | Ex. 2 | Ex. 3 | Ex. 4 | Com. Ex. 1 | Com. Ex. 2 | Com. Ex. 3* | Com. Ex. 4 |
|---|---|---|---|---|---|---|---|---|
| Width Wc of crown thick wall portion (mm) | 4 | 4 | 3 | 6 | 2 | 6 | 4 | 4 |
| Width Ws of side thick wall portion (mm) | 6 | 6 | 3 | 10 | 2 | 14 | 6 | 6 |
| Width W of thick wall portion (Wc + Ws) (mm) | 10 | 10 | 6 | 16 | 4 | 20 | 10 | 10 |
| Thickness tac of crown thick wall portion (mm) | 1.7 | 1.5 | 1.8 | 1.5 | 2.0 | 1.2 | 3.0 | 1.0 |
| Thickness tuc of crown thin wall portion (mm) | 0.7 | 0.6 | 0.7 | 0.7 | 0.7 | 0.7 | 0.7 | 0.7 |
| Ratio (tac/tuc) | 2.4 | 2.5 | 2.6 | 2.1 | 2.9 | 1.7 | 4.3 | 1.4 |
| Thickness tas of side thick wall portion (mm) | 2.0 | 2.4 | 2.8 | 1.7 | 3.0 | 1.4 | 4.0 | 1.0 |
| Thickness tus of side thin wall portion (mm) | 0.7 | 0.7 | 0.7 | 0.7 | 0.7 | 0.7 | 0.7 | 0.7 |
| Ratio (tas/tus) | 2.9 | 3.4 | 4.0 | 2.4 | 4.3 | 2.0 | 5.7 | 1.4 |
| Distance F in toe-heel direction between the center of gravity and the middle point of thick wall portion (mm) | 10 | 18 | 25 | 15 | 12 | 10 | — | 10 |
| Length L of thick wall portion (mm) | 85 | 75 | 70 | 85 | 100 | 30 | — | 90 |
| Depth of the center of gravity (mm) | 36.0 | 36.9 | 38.5 | 36.3 | 35.5 | 34.5 | — | 33.9 |
| Moment of inertia (g · $cm^2$) | 4140 | 4230 | 4350 | 4190 | 4050 | 4010 | — | 3950 |
| Amount of right- or left-ward swerve (yard) | 12.5 | 11.5 | 10.1 | 12.3 | 14.3 | 16.1 | — | 16.7 |
| Amount of front- or rear-ward swerve (yard) | 9.5 | 9.2 | 8.8 | 9.2 | 9.5 | 10.4 | — | 11.0 |

*Test was impossible due to casting failure.

From the results shown in Table 1, it is confirmed that golf club heads of the Examples according to the present invention have a large moment of inertia and the amount of rightward or leftward swerve in hitting direction is suppressed small. It is also confirmed that since the depth of the center of gravity can be made large according to the present invention, the amount of frontward or rearward swerve is small in the golf club heads of the Examples.

What is claimed is:

1. A wood-type golf club head comprising a face portion having a hitting face for hitting a golf ball on its front side, a crown portion extending from an upper edge of said hitting face and forming an upper surface of the club head, a sole portion extending from a lower edge of said hitting face and forming a bottom surface of the club head, a side portion extending between said crown portion and said sole portion from a toe side edge of said hitting face to a heel side edge of said hitting face through a back face, and having a hollow portion inside the head, wherein when viewed from above as a plane view of the head in a standard state that the head is placed on a horizontal plane at prescribed lie and loft angles, a thick wall portion extending along a head contour line defined by said crown portion to include an extreme back end point BFP located at a farthest backward position of the head and expanding toward the hollow portion side to have an increased thickness is provided in a head periphery region including said head contour line, said thick wall portion having a length L of 50 to 90 mm measured along said head contour line and a width along the head outer surface of 6 to 16 mm in a vertical section passing through a center of gravity of the head in the standard state, and comprising a crown thick wall portion which forms a part of said crown portion and has a thickness of 1.2 to 2.0 mm, and a side thick wall portion which is continuous with said crown thick wall portion to form a part of said side portion and has a thickness of 1.2 to 3.0 mm, and a distance in a toe-heel direction between a middle point of said length L and the center of gravity of the head is from 5 to 40 mm.

2. The golf club head of claim 1, wherein each of said crown portion and said side portion has a thin wall portion which is adjacent to said thick wall portion and has a thickness of 0.4 to 1.0 mm.

3. The golf club head of claim 2, wherein a ratio of the thickness tac of said crown thick wall portion to the thickness tuc of said thin wall portion of said crown portion (tac/tuc ratio) is from 2.0 to 3.0.

4. The golf club head of claim 2, wherein a ratio of the thickness tas of said side thick wall portion to the thickness tus of said thin wall portion of said side portion (tas/tus ratio) is from 2.0 to 4.5.

5. The golf club head of claim 1, wherein said side thick wall portion is thicker than said crown thick wall portion.

6. The golf club head of claim 1, wherein said head comprises at least two members joined together through a welded portion, and said thick wall portion comprising the crown and side thick wall portions is provided with at least one hole for inspecting said welded portion from the hollow portion side.

7. The golf club head of claim 1, wherein the middle point of the length L of said thick wall portion along said head contour line is located on the toe side of the center of gravity of the head.

8. The golf club head of claim 1, wherein the width Ws along the head outer surface of said side thick wall portion is from 3 to 14 mm, the width Wc along the head outer surface of said crown thick wall portion is from 2 to 10 mm, and the width Ws of the side thick wall portion is larger than the width Wc of the crown thick wall portion.

9. The golf club head of claim 8, wherein a difference "Ws−Wc" between the width Ws of the side thick wall portion and the width Wc of the crown thick wall portion is 1 to 6 mm.

10. The golf club head of claim 1, wherein said thick wall portion comprising the crown and side thick wall portions comprises a wide portion which provides a maximum width of said thick wall portion and is located in a region including said extreme back end point BFP, and narrow portions which have a smaller width Wp than said wide portion and are disposed on the both sides of said wide portion.

11. The golf club head of claim 10, wherein the width Wm of said wide portion is from 6 to 16 mm, the width Wp of said narrow portions is from 6 to 16 mm, and the ratio Wm/Wp is 1.4 or more.

12. A wood-type golf club head comprising a face portion having a hitting face for hitting a golf ball on its front side, a crown portion extending from an upper edge of said hitting face and forming an upper surface of the club head, a sole portion extending from a lower edge of said hitting face and forming a bottom surface of the club head, and a side portion extending between said crown portion and said sole portion from a toe side edge of said hitting face to a heel side edge of said hitting face through a back face, said head having a hollow portion inside the head and having a thick wall portion expanding toward the hollow portion side to have an increased thickness in a head periphery region including a head contour line which is defined by said crown portion when viewed from above as a plane view of the head in a standard state that the head is placed on a horizontal plane at prescribed lie and loft angles, wherein said thick wall portion extends along said head contour line and has a length L of 50 to 90 mm measured along said head contour line and a width along the head outer surface of 6 to 16 mm in a vertical section passing through a center of gravity of the head in the standard state, and a distance in a toe-heel direction between a middle point of said length L and the center of gravity of the head is from 5 to 40 mm, and wherein said thick wall portion comprises a crown thick wall portion which forms a part of said crown portion and has a thickness of 1.2 to 2.0 mm, and a side thick wall portion which is continuous with said crown thick wall portion to form a part of said side portion and has a thickness of 1.2 to 3.0 mm.

13. The golf club head of claim 12, wherein each of said crown portion and said side portion has a thin wall portion which is adjacent to said thick wall portion and has a thickness of 0.4 to 1.0 mm.

14. The golf club head of claim 13, wherein a ratio of the thickness tac of said crown thick wall portion to the thickness tuc of said thin wall portion of said crown portion (tac/tuc ratio) is from 2.0 to 3.0.

15. The golf club head of claim 13, wherein a ratio of the thickness tas of said side thick wall portion to the thickness tus of said thin wall portion of said side portion (tas/tus ratio) is from 2.0 to 4.5.

16. The golf club head of claim 12, wherein said side thick wall portion is thicker than said crown thick wall portion.

17. The golf club head of claim 12, wherein said head comprises at least two members joined together through a welded portion, and said thick wall portion is provided with a hole for inspecting said welded portion from the hollow portion side.

18. The golf club head of claim 12, wherein the middle point of the length L of said thick wall portion along said head contour line is located on the toe side of the center of gravity of the head.

19. The golf club head of claim 12, wherein the width Ws along the head outer surface of said side thick wall portion is from 3 to 14 mm, the width Wc along the head outer surface of said crown thick wall portion is from 2 to 10 mm, and the width Ws of the side thick wall portion is larger than the width Wc of the crown thick wall portion.

20. The golf club head of claim 19, wherein a difference "Ws−Wc" between the width Ws of the side thick wall portion and the width Wc of the crown thick wall portion is 1 to 6 mm.

21. The golf club head of claim 12, wherein said thick wall portion comprising the crown and side thick wall portions comprises a wide portion which provides a maximum width of said thick wall portion and is located in a region including an extreme back end point BFP located at a farthest backward position of the head, and narrow portions which have a smaller width Wp than said wide portion and are disposed on both sides of said wide portion.

22. The golf club head of claim 21, wherein the width Wm of said wide portion is from 6 to 16 mm, the width Wp of said narrow portions is from 6 to 16 mm, and a ratio Wm/Wp is 1.4 or more.

23. A wood-type golf club head comprising a face portion having a hitting face for hitting a golf ball on its front side, a crown portion extending from an upper edge of said hitting face and forming an upper surface of the club head, a sole portion extending from a lower edge of said hitting face and forming a bottom surface of the club head, and a side portion extending between said crown portion and said sole portion from a toe side edge of said hitting face to a heel side edge of said hitting face through a back face, said head having a hollow portion inside the head and having a thick wall portion expanding toward the hollow portion side to have an increased thickness in a head periphery region including a head contour line which is defined by said crown portion when viewed from above as a plane view of the head in a standard state that the head is placed on a horizontal plane at prescribed lie and loft angles, wherein said thick wall portion extends along said head contour line to include an extreme back end point BFP located at a farthest backward position of the head, and has a length L of 50 to 90 mm measured along said head contour line and a width of 6 to 16 mm measured along the head outer surface in a vertical section passing through a center of gravity of the head in the standard state, and wherein said thick wall portion comprises a crown thick wall portion which forms a part of said crown portion and has a thickness of 1.2 to 2.0 mm and a width Wc along the head outer surface of 2 to 10 mm, and a side thick wall portion which is continuous with said crown thick wall portion to form a part of said side portion and has a thickness of 1.2 to 3.0 mm and a width Ws along the head outer surface of 3 to 14 mm, and the width Ws of the side thick wall portion is larger than the width Wc of the crown thick wall portion.

24. The golf club head of claim 23, wherein each of said crown portion and said side portion has a thin wall portion which is adjacent to said thick wall portion and has a thickness of 0.4 to 1.0 mm.

25. The golf club head of claim 24, wherein a ratio of the thickness tac of said crown thick wall portion to the thickness tuc of said thin wall portion of said crown portion (tac/tuc ratio) is from 2.0 to 3.0.

26. The golf club head of claim 24, wherein a ratio of the thickness tas of said side thick wall portion to the thickness tus of said thin wall portion of said side portion (tas/tus ratio) is from 2.0 to 4.5.

27. The golf club head of claim 23, wherein said side thick wall portion is thicker than said crown thick wall portion.

28. The golf club head of claim 23, wherein the middle point P of the length L of said thick wall portion along said head contour line is located on the toe side of the center of gravity of the head.

29. The golf club head of claim 23, wherein a difference "Ws−Wc" between the width Ws of the side thick wall portion and the width Wc of the crown thick wall portion is from 1 to 6 mm.

* * * * *